United States Patent [19]

Flake

[11] 4,283,893

[45] Aug. 18, 1981

[54] METHOD AND APPARATUS FOR FORMING A STUDLESS WALL SYSTEM

[76] Inventor: Duane W. Flake, 10366 S. State, Salt Lake City, Utah 84070

[21] Appl. No.: 33,962

[22] Filed: Apr. 27, 1979

[51] Int. Cl.[3] ..... E04B 2/28

[52] U.S. Cl. ..... 52/241; 52/452

[58] Field of Search ..... 52/241, 336, 450–452, 52/292, 293

[56] References Cited

U.S. PATENT DOCUMENTS

| | | | |
|---|---|---|---|
| 545,873 | 9/1895 | Brown | 52/336 |
| 910,757 | 1/1909 | Wilson | 52/336 |
| 3,305,993 | 2/1967 | Nelssonn | 52/241 |
| 3,435,580 | 4/1969 | Merrill et al. | 52/576 |
| 3,760,540 | 9/1973 | Latoria et al. | 52/125 |

FOREIGN PATENT DOCUMENTS

| | | | |
|---|---|---|---|
| 5230 | of 1926 | Australia | 52/452 |
| 332331 | 7/1930 | United Kingdom | 52/336 |

*Primary Examiner*—James L. Ridgill, Jr.

*Attorney, Agent, or Firm*—Mallinckrodt & Mallinckrodt

[57] ABSTRACT

A studless wall system and method of erecting the same, incorporating a plurality of spaced apart reinforced wall panels forming a wall assembly. The wall panels are each made from easily handled composite beams or posts arranged in side-by-side fashion and secured to spacer members extending beyond adjacent ones of the beams. At least some of the spacer members are immobilized and the space between wall panels serves as an insulating space, or may have electrical wiring, plumbing, lighting fixtures, and heating conduits placed therein. The composite beams or posts comprise elongate steel channels filled with a suitable, lightweight cementitious material. The steel surfaces of the channels are positioned to be inside the wall assembly where they will effectively serve as a fire barrier.

7 Claims, 6 Drawing Figures

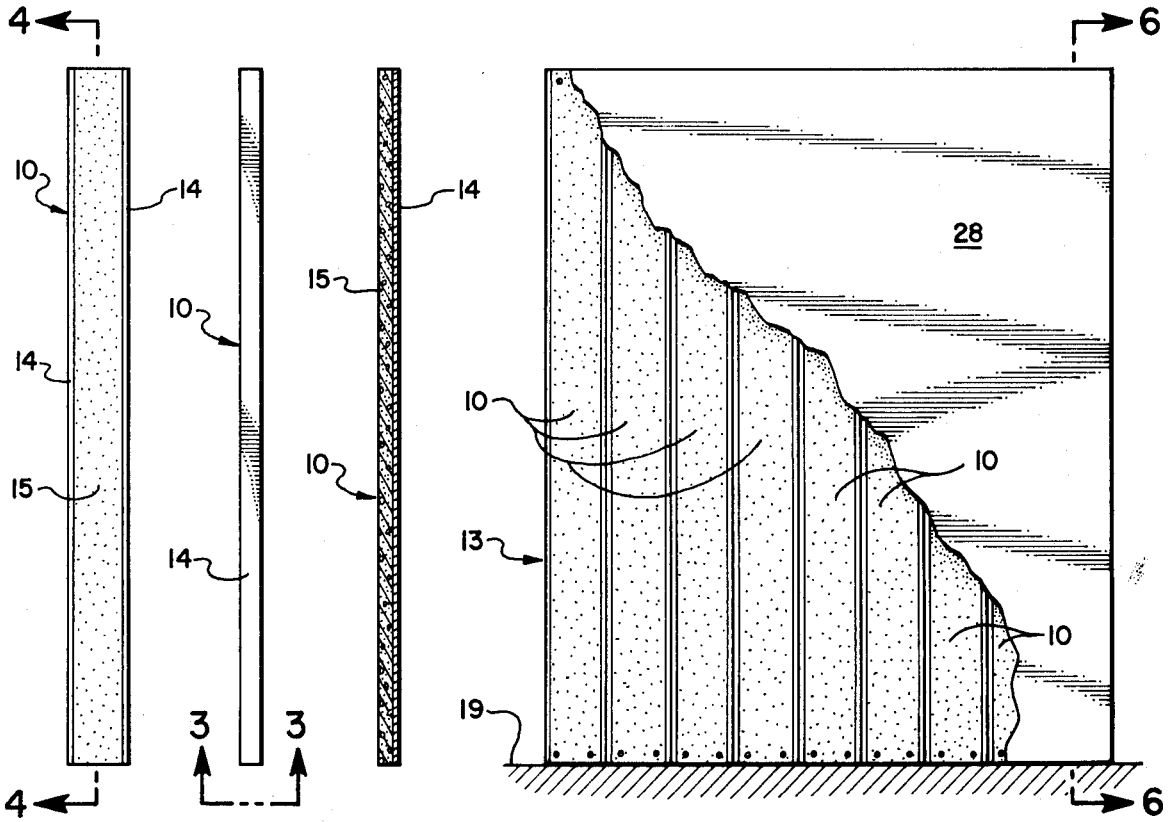
FIG. 1 FIG. 2 FIG. 4 FIG. 5
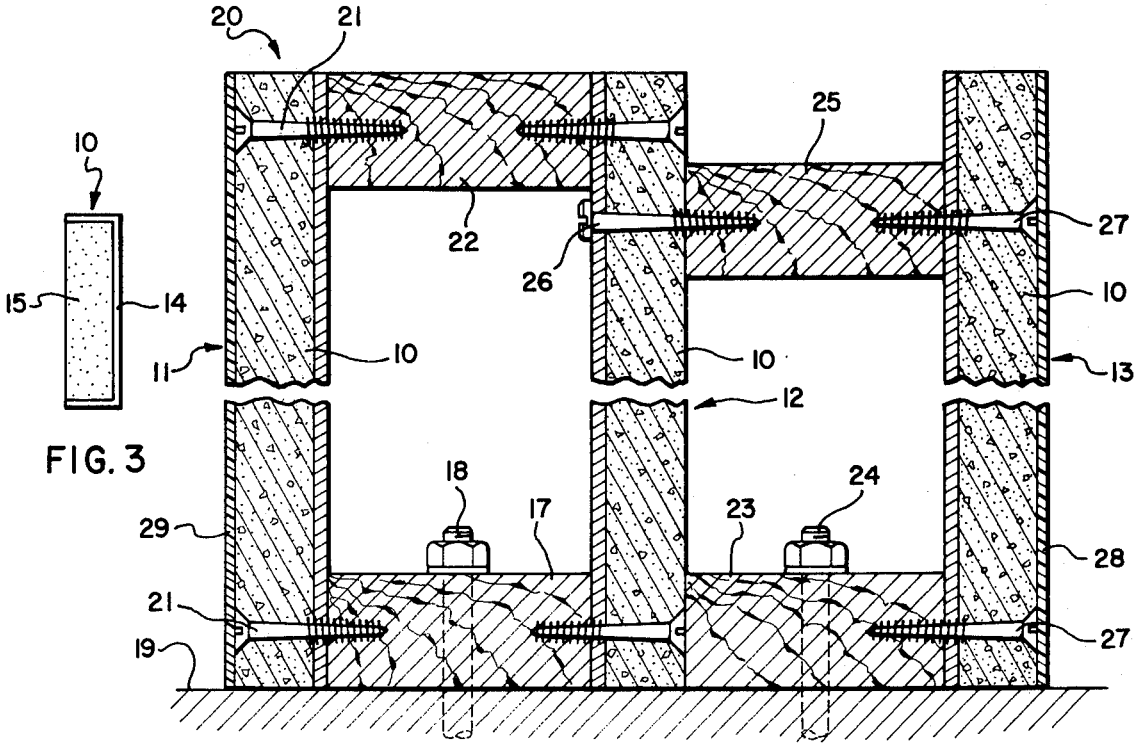
FIG. 3
FIG. 6

METHOD AND APPARATUS FOR FORMING A STUDLESS WALL SYSTEM

BRIEF DESCRIPTION OF THE INVENTION

1. Field of the Invention

This invention relates to the construction of buildings and is particularly concerned with constructing such buildings without the use of the usual studs.

2. Prior Art

The need for construction methods and apparatus to reduce the skilled labor and time necessary to construct a building has long been recognized. It is for these reasons that pre-cast and pre-formed building panels have been previously used in the construction of buildings. In U.S. Pat. No. 3,435,580, for example, a panel-type curtain wall building unit is shown in which one panel face is provided by a metal sheet component and the other face is provided by a concrete material. Thermal insulating material such as plastic is sandwiched between the two facing materials.

A pre-cast concrete building panel comprising a continuous peripheral metal channel frame in which a reinforced concrete mass is poured, in situ, is disclosed in U.S. Pat. No. 3,760,540.

So far as I am aware, however, there has not heretofore been developed a wall panel made up of a series of easily handled composite beams, nor, to the best of my knowledge, a wall assembly made up of a plurality of spaced apart wall panels.

SUMMARY OF THE INVENTION

It is a principal object of the present invention to provide method and apparatus for reducing the need for highly skilled labor and the time required in forming a wall of a building.

Other objects of the invention are to provide apparatus suitable for constructing spaced apart, multiple panel wall assemblies and of making such wall assemblies with any desired number of panels.

Still other objects are to provide easily handled composite beams suitable for arrangement into wall panels and adapted to be secured to immobilized spacer members.

Principal features of the invention include composite beams comprising individual, single, steel channels independently preformed and filled with a cementitious material, panel walls made up of composite beams in side-by-side relationship, and a wall assembly made up of at least two of the panel walls, and with each pair of adjacent panel walls being spaced apart by spacer members to which the walls are secured. Suitable finish coatings are applied to the exterior facings of the wall assembly.

Additional objects and features of the invention will become apparent from the following detailed description and drawings disclosing what is presently contemplated as being the best mode of the invention.

THE DRAWINGS

In the drawings:

FIG. 1 is a top plan view of a composite beam of the invention;

FIG. 2, a side elevation view of the composite beam of FIG. 1;

FIG. 3, an end elevation view of the composite beam of FIG. 1;

FIG. 4, a longitudinal cross section, taken on the line 4—4 of FIG. 1;

FIG. 5, a fragmentary elevation view of a wall assembly of the invention with the finish coating partially broken away to show a typical panel wall there beneath;

FIG. 6, a fragmentary vertical section, taken on the line 6—6 of FIG. 5 and showing three panel walls in spaced apart relationship and finish coatings on the exterior panel faces to make up a wall assembly.

DETAILED DESCRIPTION

Referring now to the drawings:

In the illustrated preferred embodiment, composite beams or posts, shown generally at 10 are used to form panel walls such as are shown generally at 11, 12 and 13.

Each composite beam or post comprises a single steel channel 14 of suitable depth and width, filled with a suitable lightweight cementitious material 15. The width and depth of the channel 14 may vary, but preferably are such that the weight of the overall composite beam is easily handled by persons positioning the beams in place to form a wall assembly, as will be hereinafter described in detail. As illustrated, the individual channels 14 are very narrow relative to their lengths and have elongate, flat, web members bordered laterally by respective correspondingly elongate flanges. The length of the composite beam is selected to be a standard building module length. While other suitable cementitious materials may be used, the material presently preferred is that disclosed in my copending application for U.S. patent Ser. No. 033,961, filed Apr. 27, 1979, now U.S. Pat. No. 4,229,223 issued Oct. 28, 1980, and when such material is used the preferred width of the beam is six inches (15.25 cm), the preferred depth is two inches (5 cm), and the preferred modular length is eight feet (2.44 m).

In forming a wall assembly such as is shown generally at 20 using the beams 10, a spacer member 17 is positioned and is immobilized. As shown, spacer member 17 is made of two by four lumber, bolted by anchor bolts 18 to a floor 19. Beams 10 are placed in a side-by-side position with their flanges contiguous with those of adjoining beams and with the metal faces of their web members against the spacer member 17 and secured thereto, as by screws 21 that extend through the beams and into the spacer 17 to form the panel wall 11. Other spacer members 22 are provided to extend across the beams 10 at spaced intervals along the beams and screws 21 are used to secure the beams to the spacer members. Preferably such spacer members 22 are positioned near the ends of the beams opposite the ends attached to spacer members 17 and intermediate the ends of the beams.

After the panel wall 11 has been formed, if the wall assembly is to be made up of only two panel walls, as is customary for interior walls of buildings, the electrical wiring, heating ducts, plumbing and the like for the building, are positioned between spacer members. The positioning of such building components is then ready for easy inspection by building inspectors since it is fully visible.

Once the panel wall 11 has been constructed and the wiring, heating ducts, plumbing, etc. have been positioned, the panel wall 12 is formed to close the wall. While the metal faces of the beams 10 making up the panel wall 12 may be faced in either direction, if more than two panel walls are to be used in making up the wall assembly the metal faces of panel wall 12 must be against the spacer members 17 and 22 so that the metal faces of both panel walls 11 and 12 will effectively serve as fire barriers. In addition, the outwardly facing cementitious material faces will readily receive a finish material to complete the appearance of the walls and to cover the junction lines formed between the side-by-side beams making up the panel walls, as will be hereinafter further discussed.

While a wall assembly made up of two spaced apart panel walls is generally desirable for interior, non-load bearing walls, exterior walls and frequently load bearing walls are preferably made of at least three, spaced apart panel walls, as shown in FIG. 6. In this arrangement, additional spacer members 23 are positioned to extend past the beams 10 making up panel wall 12 and are immobilized, as by anchor bolts 24 that extend into the floor 19. The fixed spacer members 23 thus help to hold the panel wall 12 in position. Other spacer members 25 are affixed as by screws 26 to the panel wall 12 on the same side of the panel as is spacer member 23 and the panel wall 13 is constructed from side-by-side beams 10 secured as by screws 27 to the spacer members 23 and 25. As previously described, any desired electrical wiring, heating ducts, plumbing, lighting fixtures, etc. can be positioned in the spaces formed between the panel walls 12 and 13 before the panel wall 13 is secured in place.

Also, as previously described, after the panel wall 13 is positioned a layer of finish material 28 is applied to the exterior surface of the panel wall and a layer of finish material 29 is applied to the exterior surface of panel wall 11. The finish materials 28 and 29 are selected in accordance with whether the surfaces to be coated are interior or exterior surfaces and the architectural appearance desired. Various cementitious materials may be used, including plasters and resins, but such materials should bond well with the cementitious material of the composite beams.

The wall assembly of the invention does not require the plates, studs and paneling of the more conventional building systems. The beams 10 are easily handled and installed, even by inexperienced workers and do not require any special handling equipment.

Although a preferred form of the invention has been herein disclosed, it is to be understood that the present disclosure is by way of example and that variations are possible without departing from the subject matter coming within the scope of the following claims, which subject matter I regard as my invention.

I claim:

1. A studless wall assembly comprising a plurality of individual, lightweight, composite beams or posts, each independently preformed as a single metal channel filled with a cementitious material, said channel being very narrow relative to its length and having an elongate, flat, web member bordered laterally by respective substantially correspondingly elongate flange members, the said beams or posts being upstanding side-by-side with the flange members of adjoining beams or posts contiguous to make a plurality of mutually spaced panel walls; spacer members between the panel walls; means securing each beam or post of each panel wall to a spacer member, with the cementitious material surface of the outermost panel walls forming an exterior surface of the wall assembly; and means immobilizing at least one spacer member between each said pair of panel walls.

2. A studless wall assembly as in claim 1, wherein a pair of panel walls are formed by the side-by-side composite beams or posts.

3. A studless wall assembly as in claim 1, wherein there are three panel walls formed by the side-by-side composite beams or posts.

4. A method of constructing a studless wall, comprising the steps of independently forming a plurality of individual, lightweight, composite beams or posts, each independently preformed as a single metal channel filled with a cementitious material, said channel being very narrow relative to its length and having an elongate, flat, web member bordered laterally by respective substantially correspondingly elongate flange members; positioning and immobilizing an elongate spacer member; positioning some of said lightweight composite beams or posts in upstanding, side-by-side relationship with the web members thereof against one side of the spacer member and with the flanges contiguous with those of adjoining beams or posts, whereby a first panel wall is formed; securing each of the beams or posts of the first panel wall to the spacer member; securing at least one additional elongate spacer member to said one side of the spacer members in spaced relationship with such spacer member; securing the beams or posts of the first panel member to each of the additional spacer members; similarly positioning others of said composite beams or posts in similar side-by-side relationship against the opposite side of the first spacer member as a second panel wall; and securing each of the beams or posts of the second panel wall to the spacer members.

5. The method of claim 4, further including the steps of applying a finish coating of cementitious material to each of the faces of the panel walls opposite to the spacer members.

6. The method of claim 5, further including the steps of applying a finish coating of cementitious material to the faces of the first and third panel walls remote from the second panel wall.

7. The method of claim 4, further including the steps of positioning additional spacer members adjacent to the side of the second panel wall member opposite the first spacer member;

positioning others of the lightweight composite beams or posts to be in side-by-side relationship with the web faces thereof against those additional spacer members to form a third panel wall; and securing each of the beams or posts of the third panel wall to those additional spacer members.

* * * * *